US008117977B2

(12) United States Patent
Reusch

(10) Patent No.: US 8,117,977 B2
(45) Date of Patent: Feb. 21, 2012

(54) AERODYNAMIC WIND PROPULSION DEVICE AND METHOD FOR CONTROLLING

(75) Inventor: Bastian Reusch, Luebeck (DE)

(73) Assignee: Skysails GmbH & Co. KG, Hamburg (DE)

( * ) Notice: Subject to any disclaimer, the term of this patent is extended or adjusted under 35 U.S.C. 154(b) by 93 days.

(21) Appl. No.: 12/674,822

(22) PCT Filed: Aug. 24, 2007

(86) PCT No.: PCT/EP2007/007449
§ 371 (c)(1),
(2), (4) Date: Feb. 23, 2010

(87) PCT Pub. No.: WO2009/026939
PCT Pub. Date: Mar. 5, 2009

(65) Prior Publication Data

US 2011/0041747 A1 Feb. 24, 2011

(51) Int. Cl.
*B63H 9/00* (2006.01)

(52) U.S. Cl. ..... 114/39.29; 114/102.1; 114/102.16

(58) Field of Classification Search ..... 114/39.11, 114/39.21, 39.29, 102.1, 102.16
See application file for complete search history.

(56) References Cited

U.S. PATENT DOCUMENTS

| | | | | |
|---|---|---|---|---|
| 4,497,272 | A * | 2/1985 | Veazey | 114/102.29 |
| 5,642,683 | A * | 7/1997 | Bedford | 114/102.1 |
| 6,003,457 | A * | 12/1999 | Chatelain | 114/39.11 |
| 6,910,434 | B2 * | 6/2005 | Lundgren | 114/102.1 |
| 6,918,346 | B2 * | 7/2005 | Grenier | 114/102.16 |
| 6,925,949 | B1 * | 8/2005 | Phillips | 114/102.1 |
| 7,546,813 | B2 * | 6/2009 | Wrage | 114/102.1 |
| 7,798,083 | B2 * | 9/2010 | Wrage | 114/102.1 |
| 7,866,271 | B2 * | 1/2011 | Wrage et al. | 114/102.16 |

FOREIGN PATENT DOCUMENTS

| | | | |
|---|---|---|---|
| DE | 35 18 131 | A1 | 11/1986 |
| GB | 2 098 947 | A | 12/1982 |
| GB | 2 098 950 | A | 12/1982 |
| WO | WO 2005/100150 | A1 | 10/2005 |

* cited by examiner

*Primary Examiner* — Lars A Olson
(74) *Attorney, Agent, or Firm* — Kilpatrick Townsend & Stockton LLP

(57) ABSTRACT

The invention relates to an aerodynamic wind propulsion device, particularly for watercrafts, comprising an aerodynamic wing being connected to a steering unit by a tractive cable, having a first end of the tractive cable connected to the steering unit and a second end of the tractive cable connected to a base platform, a guiding line having a first end connected to the aerodynamic wing or to the steering unit, a pole being connected to the base platform. According to the invention, an aerodynamic wind propulsion device as mentioned above is provided, characterized in that a second end of the guiding line is connected to the base platform during and between starting and landing maneuvers wherein the guiding line is guided through or along the pole and is capable of transferring a tensile force onto the aerodynamic wing at least during starting or landing.

52 Claims, 7 Drawing Sheets

AERODYNAMIC WIND PROPULSION DEVICE AND METHOD FOR CONTROLLING

CROSS-REFERENCE TO RELATED APPLICATIONS

Figure 1:
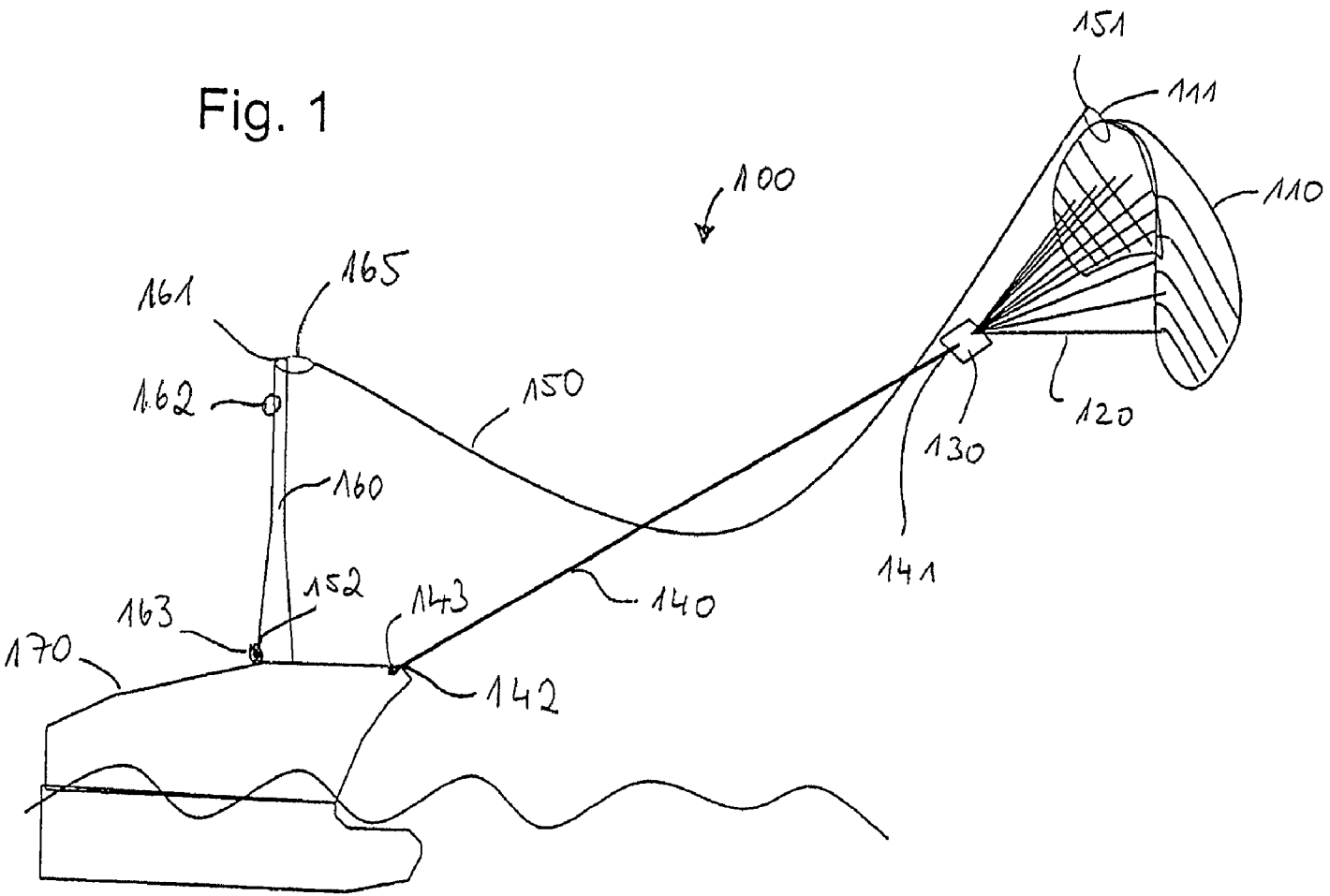

This application is a National Stage of International Application No. PCT/EP2007/007449 filed Aug. 24, 2007, the disclosure of which is incorporated herein by reference.

The invention relates to an aerodynamic wind propulsion device, particularly for watercrafts, comprising an aerodynamic wing being connected to a steering unit located below the aerodynamic wing via a plurality of lines, particularly steering lines and/or tractive lines, a tractive cable, wherein a first end of the tractive cable being connected to the steering unit and a second end of the tractive cable being connected to a base platform, the aerodynamic wing having an aerodynamic profile which generates an uplift force in the direction of the traction cable when the airflow direction is about perpendicular to the tractive cable, a guiding line having a first end connected to the aerodynamic wing or to the steering unit, a pole being connected to the base platform, particularly a mast with a head on top, the pole serving as a docking point for the aerodynamic wing during starting and landing.

A further aspect of the invention is a method for controlling the flight of a wing element for pulling a nautic vessel.

Today, carbon-based fuels like diesel or heavy fuel oil (HFO) are used as a key resource for propelling nautic vessels. Mostly, diesel engines are used to provide the driving force for the vessels. With increasing costs for such carbon-based resources it becomes attractive to apply alternative methods for providing the driving force for nautic vessels.

WO 2005/100147 A1 discloses a positioning device for controlling a wing element which is connected via a tractive cable to a ship to serve as main or auxiliary drive. Such propulsion system based on wing elements flying at high altitude and pulling the ship via a tractive force require large-scale wing elements and the control of such wing elements is a challenging task. In WO 2005/100147 A1 it is proposed to veer out or haul in the tractive cable in response to the flight condition of the wing element. Whereas by such control mechanism a certain degree of flight control can be achieved it is not sufficient to control the wing element in all flight conditions, in particular when the wind changes its strength or direction significantly or during starting and landing manoeuvres of the wing element.

To improve steerability of such wing elements in difficult wind conditions it is known from WO 2005/100148 A1 to couple a steering unit close below the wing element via a number of control lines and to connect the wing element to the nautic vessel via such steering unit by a tractive cable extending between the nautic vessel and the steering unit. By this, control of the wing element can be significantly improved but it is still a challenging task to control the wing element at low altitudes such as during starting and landing procedure.

WO 2005/100149 A1 proposes various sensors to improve control of a wing element towing a nautic vessel. Whereas these and the former techniques may significantly improve the steerability of aerodynamic wing elements during regular flight it remains still a quite challenging task to control the wing element at low altitudes, in particular when the strength and direction of the wind significantly and quickly changes. Loss of control over the wing element however might result in loss of the whole system since it is not possible to rescue the system if a large-scale wing element has come into contact with the water surface.

To improve steerability during starting and landing manoeuvres, WO 2005/100150 proposes a telescopic mast erected onto the foredeck of the nautic vessel close to the fixing point of the tractive cable coupling the wing element to the nautic vessel. Using such mast, the wing element can be directly coupled to the top of the mast, thus facilitating starting and landing manoeuvres. To achieve engagement between the wing element and the top of the mast a rudder pendant is slidably coupled to the tractive cable at one end and connected to the wing element at the other end. This rudder pendant is accessible if the tractive cable has been hauled in so far that the wing element is in low altitude and can be handled such that it is decoupled from the tractive cable and guided in such a way as to pull the wing element towards the top of the mast. Whereas such a technique may significantly improve manoeuvrability of the wing element during starting and landing procedure if the rudder pendant is decoupled from the tractive cable and guided such that a pulling force in the direction of the top of the mast can be applied to the wing element, it is rather complicated to use and handle the rudder pendant in the course of the starting or landing manoeuvre and failure to couple or decouple the rudder pendant to/from the tractive cable may result in failure of the whole system and loss of the wing element.

It is a first object of the present invention to provide a device facilitating and improving control of a wing element at starting and landing manoeuvres.

It is a further object of the invention to provide a device and a method for rescuing a wing element in case of sudden loss of lifting force, e.g. due to sudden change of strength and/or direction of the wind.

Still further, it is an object of the invention to provide a device improving and facilitating the control of a wing element at low and high forces acting onto the tractive cable or the wing element.

According to a first aspect of the invention, an aerodynamic wind propulsion device as mentioned above is provided, characterized in that a second end of the guiding line is connected to the base platform during and between starting and landing manoeuvres wherein the guiding line is guided through or along the pole and is capable of transferring a tensile force onto the aerodynamic wing at least during starting or landing.

The aerodynamic wind propulsion device according to the invention provides a sophisticated set-up for controlling an aerodynamic wing. The basic concept of the invention is to provide a continuous guiding line that is connected to the aerodynamic wing with its one end and connected to the base platform with its other end. According to the invention this continuous connection is not only provided during starting and landing manoeuvres but also during a flying phase between starting and landing manoeuvres.

During starting and landing manoeuvres the aerodynamic wing is transferred from a position close to the pole to a flying position high above the base platform and vice versa. By providing a continuous guiding line between the base platform and the aerodynamic wing the reaction time to control the aerodynamic wing is reduced, since decoupling and transfer of the second end of the guiding line from the tractive cable to the base platform or the mast head is not required anymore.

According to the invention the guiding line is guided through or along the pole and therefore capable of permanently providing a connection between the aerodynamic wing and the pole, particularly the masthead. According to the invention the guiding line is capable of transferring a tensile force directly onto the aerodynamic wing without incorporating force transfer via the steering unit. By this, control of the aerodynamic wing can be improved applying this tensile force via the guiding line. By providing a low constant tensile force in the guiding line the reaction time to control the aerodynamic wing is further reduced because the tensile force can be increased immediately without having to haul in any slack sections of the guiding line. This direct control of the aerodynamic wing provided by the invention is of special importance especially for starting and landing manoeuvres, since during these manoeuvres there is a high need for controlling the aerodynamic wing. But also during the flying phase between starting and landing manoeuvres the continuous and permanent connection between the base platform and the aerodynamic wing via the guiding line provides a significant advantage, since on the one hand, the position of the co-flying guiding line can be controlled and twisting of the guiding line for example with the traction cable can be reduced or prevented. On the other hand, by providing a continuous connection via the guiding line it is possible to immediately initiate a rescue manoeuvre in case of an instable situation threatening to lose the aerodynamic wing due to collapse of the aerodynamic wing and/or watering of the aerodynamic wing.

The guiding of the guiding line through or along the pole is owed to the fact that the starting and landing manoeuvre of the aerodynamic wing usually begins/ends in a position wherein the wing is close to the top of the pole, particularly the masthead, and the steering unit is close to the foredeck of the vessel. Thus, it is desirable to be able to pull the aerodynamic wing via the guiding line towards the masthead.

According to a further aspect of the invention, the first end of the guiding line is connected to a rigid stiffening element secured to the aerodynamic wing, particularly a central stick, and the top of the pole preferably comprises a rigid adapter element adapted to be coupled to the stiffening element.

This arrangement ensures a safe and rigid docking connection between the masthead and the aerodynamic wing. The course of the guiding line through or along the masthead is realized in a way that ensures the stiffening element of the aerodynamic wing to be pulled correctly towards the adapter element in order to provide a smooth docking process.

The invention may be further improved in that a plurality of reefing lines is located across the aerodynamic wing in order to change the aerodynamic profile or dimension of the aerodynamic wing in a manner that aerodynamic properties are changed, e.g. the uplift force is reduced when the reefing lines are hauled in. With this preferred embodiment it is possible to reduce the uplift forces during the landing process of the aerodynamic wing. During landing, it is desirable to be able to move the aerodynamic wing easily to its landing position close to the masthead. Since the aerodynamic wing is dimensioned to create a maximal uplift force during the flying phase, its profile and dimension may work against a pulling force trying to pull the aerodynamic wing downwards and towards the masthead. Thus, it is preferred that the uplift force of the aerodynamic wing is reduced during landing manoeuvres. This is realized using reefing lines, that reach across the surface and profile of the aerodynamic wing, preferably in a symmetric pattern in relation to a central stiffening element. These reefing lines, while being hauled in, change the dimension and profile of the aerodynamic wing in a way to reduce the uplift force.

This embodiment can be further improved in that the first end of the guiding line is connected to the plurality of reefing lines to effect hauling in and veering out of the reefing lines via the guiding line. This can be realized for example by merging the reefing lines to one line that is connected to the guiding line. A connection element may be provided for connecting the first end of the guiding line to the plurality of reefing lines or to a single line the plurality of reefing lines has merged into.

This embodiment can be further improved in that the plurality of reefing lines is at least partially guided along a stiffening element such as a central stick secured to the aerodynamic wing. In this way the course of the single reefing lines can be organized and handled in a easier way. Also, the connection of the plurality of reefing lines to the guiding line can be realized using the stiffening element.

In order to even better control the reefing lines, a preferred embodiment provides a blocking element preventing hauling in of the reefing lines in a blocking state and allowing hauling in of the reefing lines in a non-blocking state via a load transmission connection between the plurality of reefing lines and the first end of the guiding line. This way, a tensile force can be applied to the guiding line when the blocking element is in a blocking state, without hauling in the reefing lines. This is preferred for example during the flying phase, where no change in dimension or profile of the aerodynamic wing is desired. Also, during starting and landing phases, it is desirable to actively define the starting of hauling in of the reefing lines in order to be able to better control the movement of the aerodynamic wing. Thus, it might be desirable, for example during landing, to bring the aerodynamic wing into or close to its landing position via hauling in the guiding line and only changing the blocking element from its blocking state to its non-blocking state when the aerodynamic wing has reached or almost reached its landing position. This way it can be prevented, that the aerodynamic wing is accidentally changed in its profile or dimension while in a position further from its landing position and thus risking to decrease uplift force and thus lose the aerodynamic wing by watering it for example.

A further embodiment of the invention is characterized in that the pole is a mast element, particularly a telescope mast and/or a mast having a pivotal coupling of the base platform to fold the mast and bring it into an essentially horizontal orientation. This way it is possible to minimize the vertical extension of the mast during a phase where the aerodynamic wind propulsion device is not used and therefore the mast not needed. Since the prime area of application of the aerodynamic wind propulsion device is on watercrafts, wind resistance usually is a parameter to be optimized. Thus, while the aerodynamic wind propulsion device is not in use, it is desirable to minimize the wind resistance resulting from the mast. Also, this way it is possible to more easily reach the top of the mast and the masthead, where the rigid masthead adapter is located, in case the mast, the masthead, or the masthead adapter need inspection, overhaul or other measures requiring a close handling of the mast.

A further preferred embodiment of the invention is characterized in that the guiding line is inserted into or attached to the pole at the top, particularly the masthead, and is guided via a pulley. By attaching the guiding line in this manner to the masthead it is possible to pull the aerodynamic wing into a position close to the masthead, which is usually desirable for starting and landing the aerodynamic wing. By guiding the guiding line via a pulley it is ensured, that the guiding line can be guided essentially in variable angles in relation to the base platform and to minimize friction at the turning point.

In a further embodiment of the invention the tractive cable is capable of carrying high tensile forces and/or the guiding line is capable of carrying low tensile forces, particularly tensile forces of about 0.5-3%, in particular 1%, of the tensile forces of the tractive cable. These characteristics are due to the fact, that the main forces created during the flying phase by the uplift force of the aerodynamic wing are transferred to the base platform via the tractive cable, which therefore has to be capable to carry very high tensile forces. The guiding line on the other hand is used to control the aerodynamic wing during phases where the aerodynamic wing does not reach its maximal uplift force, so that the forces resulting in the guiding line will generally be much lower than the ones in the tractive cable. This relation in forces to be carried also results in a similar relation regarding the dimensions of the tractive cable and the guiding line. The guiding line may have a much smaller diameter than the tractive cable, thus significantly reducing the weight of the guiding line which is acting onto the wing element. Also, different materials for the tractive cable and the guiding line might be used.

Still further it is preferred to provide a signal and/or power transmission, which is included in the guiding line. By this preferred embodiment signals and/or power can be transmitted from the base platform to the wing element or vice versa via a signal line and/or power line included in the guiding line. The signal line and/or power line may be arranged parallel to the guiding line or coaxial within the guiding line. Including such signal line and/or power line into the guiding line will not effect a significant increase of the weight of the guiding line or the dimensions of the guiding line and hence its wind resistance. Thus it will not significantly decrease the power of the wing element for pulling the nautic vessel.

According to a further important preferred embodiment a coupling element is provided for selectively fixing the guiding line to the steering unit. Since the guiding line is coupled with its first end permanently to the wing element, this may affect the flight attitude of the wing element and such effect will increase at high altitudes since the guiding line must be veered out and thus the weight of the guiding line acting onto the wing element will increase. Often, the flight attitude of the wing element is levelled out by the plurality of lines coupling the wing element to the steering unit and an additional effect induced by the guiding line will significantly reduce the power of the aerodynamic wing element and may even result in loss of control. To overcome these drawbacks the guiding line may be coupled to the steering unit in such a way that the force induced by the weight of the guiding line not further acts directly onto the wing element but onto the steering unit. This will reduce or eliminate forces acting onto the wing element via the guiding line and result in the wing element being loaded only via the plurality of lines coupling the wing element to the steering unit. Such selective coupling of the guiding line to the steering unit may easily be realized by a short line connecting the guiding line at a point which is arranged in a distance from the first end coupled to the wing element corresponding to the distance between this first end and the steering unit. The short coupling line is connected to the steering unit in such a way that it can be hauled in and thus pulls the guiding line to the steering unit and fixes it thereto when the coupling line is completely hauled in. Before initiating a landing manoeuvre the coupling line may be veered out to allow a direct pulling force to be exerted to the wing element via the guiding line.

According to another aspect of the invention, the aerodynamic wind propulsion device as mentioned above or described in the introductory portion of this description may be further improved in that a section of the guiding line extends between the base platform and the top of the pole and the pole comprises a tractive device, that is capable of applying a tensile force to this section.

Usually, a section of the guiding line extending between the base platform and the top of the pole is free of tension while the guiding line is not in use to guide the aerodynamic wing, often resulting in kinks, knots or the like when forces are applied to the guiding line and a movement, particularly a sudden movement, of the guiding line is necessary. According to the invention the guiding line is constantly exposed to a low tensile force in this section, the force being sufficient to keep the guiding line in a tense state and thus preventing the forming of kinks, knots or the like during hauling in or veering out.

The application of this concept is not restricted to the guiding line but can extend to any line, particularly the reefing lines, that may be pulled into or along the mast as well. The advantage of preventing the forming of kinks, knots or the like during hauling in or veering out by providing a tensile force in a section of the line may be used for any line of an aerodynamic wind propulsion device.

Another advantage of this embodiment is that a constant tensile force in the section between the base platform and the top of the pole of the guiding line enables and/or enhances the introduction of a constant tensile force to the guiding line by adjusting the tensile force applied to the guiding line at its second end corresponding to the tensile force applied to the guiding end through the uplift of the aerodynamic wing.

This embodiment of the invention can be further improved in that the tractive device is a pair of tension pulleys arranged opposed to each other and engaging the guiding line between them, wherein at least one of the tension pulleys is capable of applying the tensile force via a torque onto the guiding line. The tension pulleys can be located for example below the pulley at the top of the mast. Tension pulleys apply the tensile force to a cable or line by embracing the cable or line between them and being pressed against the cable or line via a spring for example. The tension of the spring and the torque to be applied to the guiding line have to be adjusted to the dimension and material of the cable or line and of the tension pulleys, in order to prevent slip between the cable or line and the tension pulleys or to at least prevent excessive wear of the cable or line and the tension pulleys.

The invention can be further improved in that at least one of the tension pulleys is being driven by a driving assembly, wherein the driving assembly is a rotating field magnet particularly. In order for the tension pulleys to be able to apply a tensile force via a torque onto the guiding line, it is preferred that the tension pulleys are being driven. A rotating field magnet is a special torque motor applicable for continuous operation where a torque has to be applied.

This invention can be further improved in that the tension pulleys can be set to a mode wherein they are free to rotate to follow a movement of the guiding line or the tractive cable respectively. Since the guiding line or the tractive cable respectively are subject to veering-out- and hauling-in-movements it is not desirable for the guiding line or the tractive cable, respectively, to be blocked by the tension pulleys. Therefore the tension pulleys are capable to rotate freely while the guiding line or the tractive cable respectively are being veered out or hauled in. Since usually the forces applied to the guiding line during veering out or hauling in are larger than the tensile force applied to the guiding line via the torque of the tension pulleys, this force is easily overcome. Since there is no blocking mechanism of the tension pulleys, once the higher force for veering in or hauling out is applied, the tension pulleys can rotate freely according to the movement of the guiding line or the tractive cable respectively.

The preferred embodiment can be further improved in that the torque and/or the tensile force of the tension pulleys can be adjusted, particularly to compensate wear on the tension pulleys or the guiding line or the tractive cable respectively. This adjustment is necessary, since wear or abrasion of either the guiding line or the tractive cable respectively or the tension pulleys will lead to a lower resulting tensile force in the guiding line or tractive cable respectively given a constant torque. In the worst case no tensile force is applied and thus the function of the tractive device does not exist. Since a precise control of the applied forces is necessary for a successful control of the aerodynamic wing, it is important to adjust, particularly increase, the applied torque and/or the tensile force between the tension pulleys in order to achieve a resulting tensile force in the guiding line or tractive cable respectively that is constant over time.

According to another aspect of the invention, the aerodynamic wind propulsion device as mentioned above or described in the introductory portion of this description may be further improved in that the second end of the tractive cable and/or the second end of the guiding line are connected to the base platform via at least one winch for veering-out and hauling-in the tractive cable or the guiding line, respectively, wherein the at least one winch is equipped with two operating modes, wherein the first operating mode applying a low force with high speed and the second operating mode applying a high force with low speed.

This way it is possible to adjust the force and speed used during veering out and hauling in to the current situation. For example, if a long section of a line or cable has to be hauled in or veered out, while the force resulting from the uplift of the aerodynamic wing is low, it is desired to use an operating mode applying only low force or moving the line or cable at a high speed. Whereas in a situation, where tensile forces opposing a hauling in are very high, it is preferred to use an operating mode applying a high force at a low speed.

This embodiment of the invention is preferably improved in that the at least one winch is connected to one drive unit and said drive unit is capable of being operated in the two modes two separate drive units, one drive unit being capable of being operated in the first mode and the other drive unit being capable of being operated in the second mode. Due to the high forces occurring when using an aerodynamic wind propulsion device, it is preferred to use drive assemblies to drive the winches. In order to be able to apply different operating modes as described above, a single drive unit either has to comprise two operating modes, that can be chosen from or switched in between, or two separate drive units are provided, one for the first mode and one for the second mode.

This embodiment can be further improved in that an aerodynamic wind propulsion device according to the invention, having two separate drive units, further comprises at least one coupling for selectively coupling one of the two drive units to the at least one winch. If separate drive units are used to realize the different operating modes, it has to be ensured, that the required drive unit is coupled to the winch as required to operate in this specific operating mode. If there are two drive units associated with one winch, a coupling may selectively couple either one drive unit or the other to the winch according to the required operating mode.

In a further aspect, the invention may be embodied in a watercraft comprising an aerodynamic wind propulsion device as described above. In this respect, reference is made to the international applications mentioned in the introduction of this description describing such systems for towing watercraft.

Further, the invention may be embodied in the use of an aerodynamic wind propulsion device as described above to drive a watercraft.

Further, the invention may be embodied in the use of an aerodynamic wind propulsion device as described above to start, land, fly and/or rescue an aerodynamic wing.

According to a further aspect of the invention a method for controlling an aerodynamic wind propulsion device, as described in the introductory part of this description is provided, that is characterized by the steps of connecting a second end of the guiding line is to the base platform, guiding the guiding line through or along the pole during and between starting and landing manoeuvres and managing the tensile force in the guiding line according to different functions of the guiding line at least during starting and landing manoeuvres.

One advantage of this embodiment is the reduction of reaction time for controlling the aerodynamic wing via the guiding line as described above. Another advantage is a damping of the movements of the aerodynamic wing and thus an improvement of the controllability of the aerodynamic wing and a smoother starting and landing process.

In a first embodiment it is preferred that the method comprises adjusting the tensile force applied to the guiding line at its second end, particularly through a winch connected to the base platform and/or a tractive device located at the pole, corresponding to the tensile force applied to the guiding line at its first end through the uplift force of the aerodynamic wing so that a certain tensile force is sustained in the guiding line during a guiding phase as part of starting or landing manoeuvres.

This concept is realized by establishing a force equilibrium taking up the resulting force of the aerodynamic wing, the force applied by the winch and a predefined initial tension of the guiding line. By controlling the forces applied by the winch this equilibrium can be adapted constantly to changes in the resulting force of the aerodynamic wing, thus keeping the initial tension of the guiding line constant or near constant with the advantages mentioned above.

Further, it is preferred that the method comprises veering-out and hauling-in the guiding line parallel to the traction cable during a flying phase, wherein little or no tensile force is sustained in the guiding line. For a certain embodiment this may be the case for a situation, where the distance between the steering platform and the base platform is about 40 m or more.

It is still preferred to haul-in the guiding line via applying a force at the second end of the guiding line during landing or in order to rescue the aerodynamic wing in a situation of instability. For a certain embodiment this may be the case for the lowest flying zone, where the distance between the steering platform and the base platform is about 30 m or less.

In a further embodiment of the invention it is preferred that during a starting phase the aerodynamic wing is unfolded using a driving assembly with high force and low speed.

In a further preferred embodiment at least one winch connected to the second end of the tractive cable and/or the second end of the guiding line for veering-out and hauling-in the tractive cable or the guiding line respectively is provided, and the at least one winch is operated in two operating modes, wherein the first operating mode applies a low force with high speed and the second operating mode applies a high force with low speed. Reference is made to the description of the details and advantages of two operating modes given above.

A further development of the invention is preferred wherein the winch of the guiding line is operated in the first operating mode during the guiding phase, the winch of the guiding line is operated in the second operating mode during unfolding and folding of the aerodynamic wing and the winch of the guiding line is operated in first operating mode or the second mode during the rescue manoeuvres. The choice of the operating mode depends on the circumstances under which the aerodynamic wind propulsion device is operated.

According to another aspect of the invention a method as mentioned above or in the introductory portion of this description may be further improved by applying a tensile force to a section of the guiding line the section being arranged between the base platform and the top of the pole. To this extent, the pole may comprise a tractive device, particularly a pair of tension pulleys arranged opposed to each other which engages the guiding line between them, that is capable of applying a tensile force, particularly via a torque, onto the guiding line.

In a further embodiment of the invention it is preferred to drive the tractive device by a driving assembly, particularly a rotating field magnet.

Finally it is preferred to adjust the torque and/or the tensile force of the tractive device, particularly to compensate wear of the guiding line or the tension pulleys.

Reference is made to the description of the details and advantages of the tractive device, particularly the pair of tension pulleys, given above.

Preferred embodiments of the invention shall now be described with reference to the attached drawings, in which FIG. 1: shows a perspective view of a first embodiment of the device according to the invention during the flying phase, FIG. 2: shows a perspective view of the first embodiment of the device according to the invention during initiating of the guiding phase, FIG. 3: shows a perspective view of the first embodiment of the device according to the invention in landing position, FIG. 4: shows a schematic sectional view of a detail of a second embodiment of the device according to the invention, FIG. 5: shows a perspective view of a third embodiment of the device according to the invention, FIG. 6: shows a perspective view of the third embodiment of the device according to the invention in starting and landing condition, and FIG. 7: shows a schematic view of a detail of a fourth embodiment of the device according to the invention.

FIG. 1 shows an aerodynamic wind propulsion device 100 comprising an aerodynamic wing 110 connected to a steering unit 130 located below the aerodynamic wing 110 via a plurality of lines 120, particularly steering lines and/or fixing lines, a tractive cable 140, wherein a first end 141 of the tractive cable is connected to the steering unit 130 and a second end 142 of the tractive cable is connected to a base platform 170. The aerodynamic wind propulsion device 100 also comprises a guiding line 150 having a first end 151 connected to the aerodynamic wing 110 and a mast 160 being connected to the base platform 170, the mast having a masthead 161.

The second end 152 of the guiding line is connected to the base platform 170 via a winch 163. The guiding line 150 is guided to the masthead 161 and runs along the mast 160 towards the winch 163.

The tractive cable 140 is connected with its second end 142 to another winch 143. It can be seen from FIG. 1 that during the flying phase the aerodynamic wing is located high above and generally in front of the vessel 170. Generally, the position of the aerodynamic wing in relation to the vessel 170 depends on wind conditions and other parameters like vessel speed, wave height and others and the wing is driven in certain figures to increase the tensile force for pulling the vessel. During the flying phase the traction cable 140 transfers the tensile force applied by the uplift force of the aerodynamic wing 110 to the base platform. The guiding line 150 is connected with its first end 151 to a central stick 111 disposed within the wing for stiffening the wing element. At the front end of the wing, a coupling section of the stick 111 protrudes. This coupling section is adapted to be mechanically coupled to the masthead 161. The second end 152 of the guiding line is wound around the winch 163 that is connected to the base platform 170 so that the guiding line is "co-flying" with the tractive cable but is not carrying any significant tensile force. In order to prevent the "co-flying" guiding line 150 from twisting with other elements, e.g. the traction cable 140, and in order to reduce reaction time, a small tensile force is applied to the guiding line 150. This is done by veering out and hauling in the guiding line 150 via the guiding line winch 163 so far, that a small, preferably constant and predetermined tensile force remains in the guiding line 150.

Figure 2:
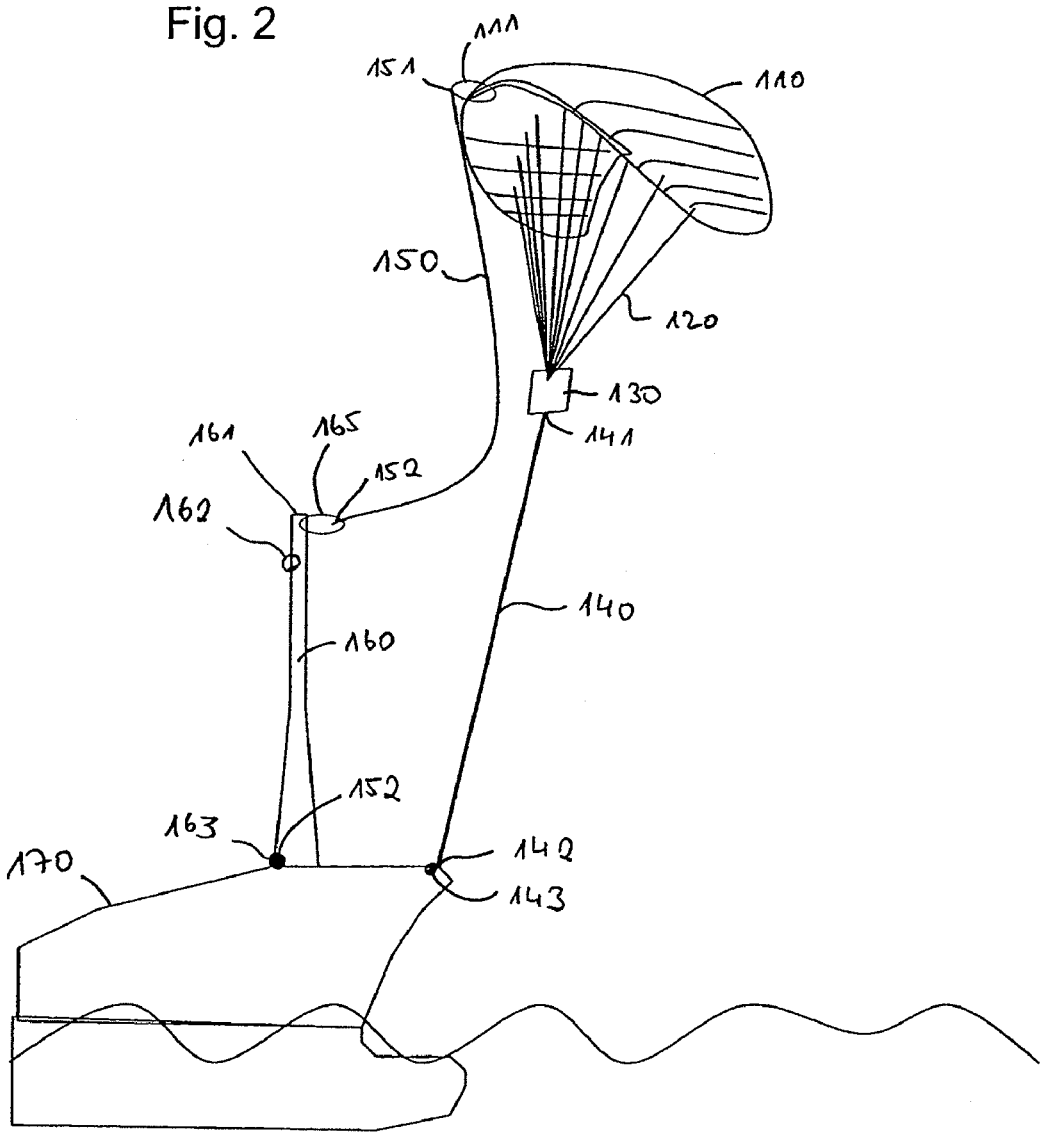

FIG. 2 shows the same embodiment as shown in FIG. 1 with the device in a position where the guiding phase is initiated. As can be seen from FIG. 2, the aerodynamic wing 110 is in a position in relation to the vessel 170, where the aerodynamic wing has been brought closer to the vessel 170 compared to FIG. 1 by hauling in the tractive cable 140. The remaining length of the tractive cable between the base platform and the steering unit is only a little longer than the length of the mast 160, as can be seen from FIG. 2. This indicates that the guiding phase is to be initiated, since the guiding phase preferably starts when the remaining length of the tractive cable 140 between the base platform 170 and the steering unit 130 is about the same as the height of the mast 160.

The "co-flying" guiding line 150 has been hauled in parallel to the tractive cable 140, but still only carries a very low tensile force, as can be seen from the flared form of the guiding line 140 in FIG. 2.

To start the guiding phase the tractive cable 140 is further hauled in while parallel the guiding line 140 is hauled in until a desired guiding forced is applied to the guiding line 150. This guiding phase is continued until the aerodynamic wing has reached its landing position as shown in FIG. 3. During the guiding phase the winch 163 is operated in the first operating mode, applying a low force with high speed. Only for the very last section of the guiding line to be hauled-in, particularly a section of a length that equals approximately mast height and depends on the size of the aerodynamic wing, the winch is operated in the second operating mode applying a high force with low speed in order to provide the force necessary to dock the central stick of the aerodynamic wing 110 to a complementary rigid adapter at the masthead 265.

Figure 3:
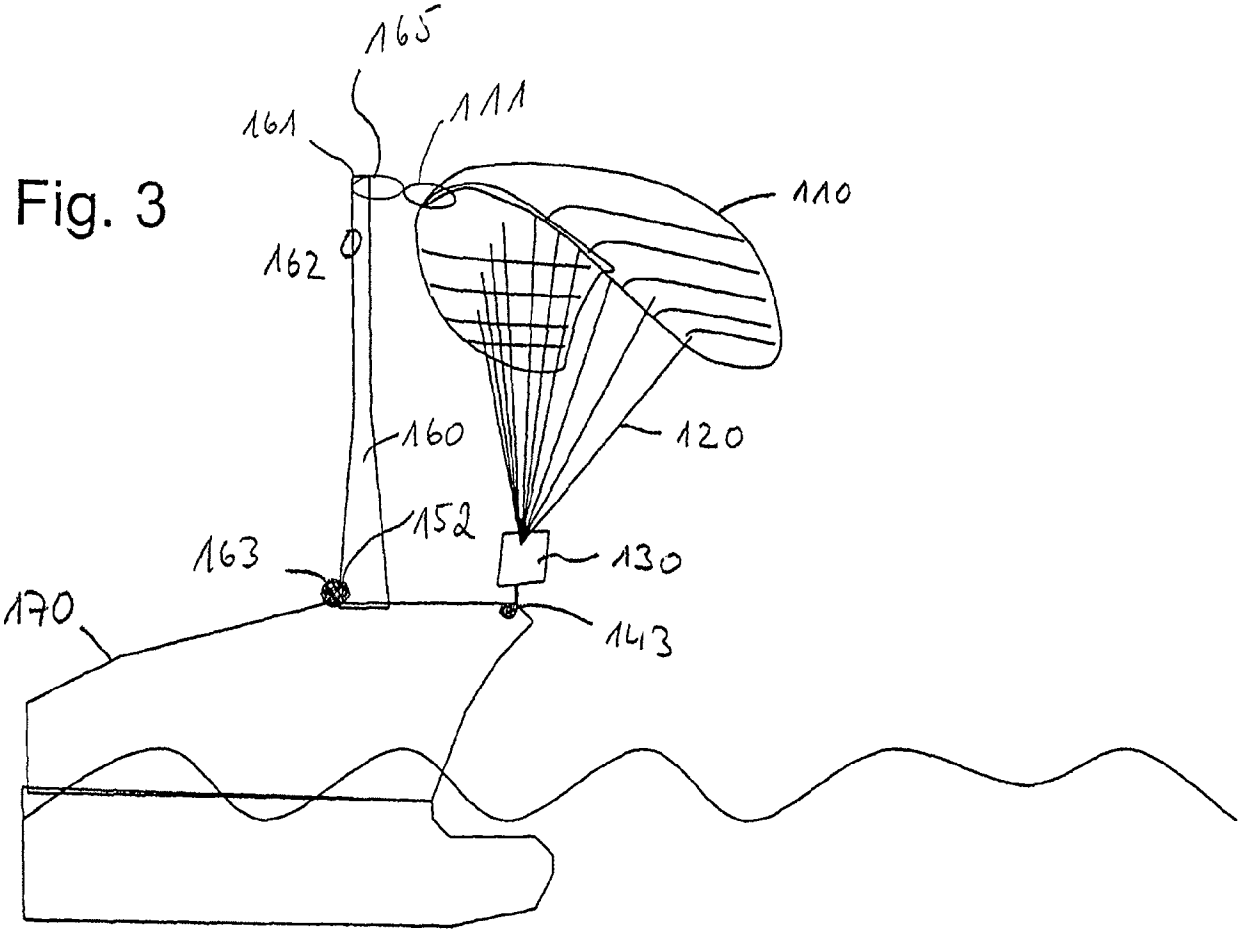

The landing position as shown in FIG. 3 is characterized by the steering unit 130 being close to or touching the base platform 170 and the central stick 111 secured to the aerodynamic wing is close to or connected to the complementary rigid adapter element located at the masthead 265. This implies that generally for aerodynamic wind propulsion devices the distance between the steering unit and the aerodynamic wing should be approximately the same as the height of the pole or mast respectively.

The guiding line is coupled to the wing via a plurality of reefing lines arranged within the wing such that pulling the reefing lines reduces the dimension of the wing.

In this position the reefing lines of the aerodynamic wing 110 are hauled in in order to initiate a controlled collapse of the aerodynamic wing so that the guiding line and the reefing lines can be completely hauled-in and the aerodynamic wing itself can be retrieved. During this phase the winch 163 is operated in the second operating mode applying a high force with low speed.

Figure 4:
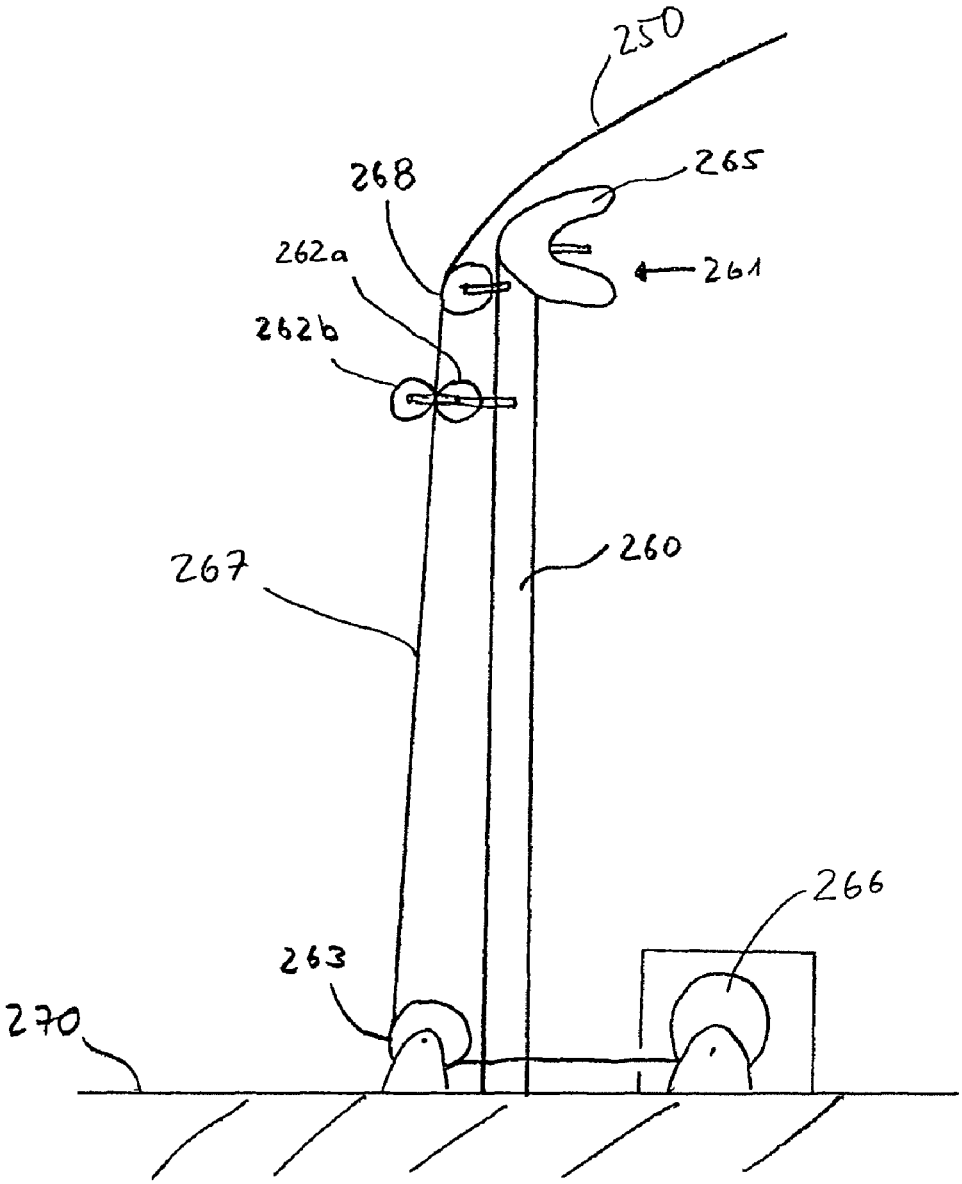

In FIG. 4 the arrangement of the tension pulleys 262 and the winch 263 are presented in a more detailed schematic view. The guiding line 250 is guided via a pulley 268 that is located near the top of the mast 261. Below this pulley 265 a pair of tension pulleys 262 is located. The guiding line 250 continues through the two tension pulleys 262*a* and 262*b* to the winch 263 that is connected to the base platform 270 and from there on to a cable storage means 266, also connected to the base platform 270. The tension pulley 262*a* is being driven by a rotating field magnet (not shown) to apply a tension force via a torque onto the section 267 of the guiding line, that extends from the winch 263 at the base platform 270 to the pair of tension pulleys 262 at the top of the mast, in order to keep the section 267 of the guiding line under a constant low tension.

When the guiding line 250 is veered-out or hauled-in using the winch 263 the tension pulleys 262 change to a state where they can rotate freely to accommodate the movement of the guiding line 250 and do not block this movement.

Figure 5:
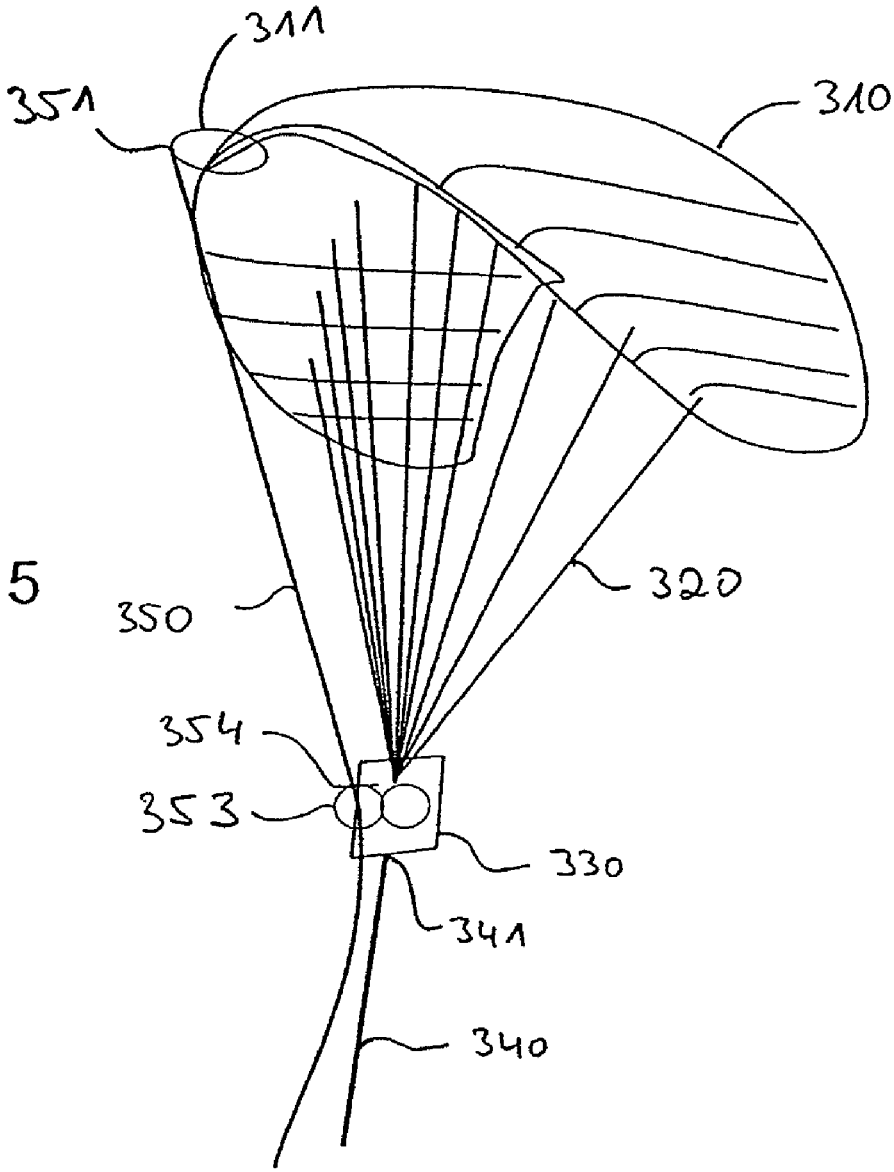

FIG. 5 shows a perspective view of a third embodiment of the device according to the invention, wherein the guiding line 350 is connected with its first end 351 to the central stick 311 of the aerodynamic wing 310. The guiding line can selectively be fixed to the steering unit 330 by a short coupling line 354 connecting a point 353 of the guiding line which is arranged in a distance from the first end 351 coupled to the aerodynamic wing 310 which distance approximately corresponds to the distance between the aerodynamic wing and the steering unit 330. The short coupling line 354 is connected to the steering unit 330 in such a way that it can be hauled in and thus pulls the guiding line 350 to the steering unit 330 and fixes it thereto when the coupling line 354 is completely hauled into the steering unit. FIG. 5 shows the embodiment in a flight situation, where it is desirable to load the aerodynamic wing 310 only via the plurality of lines 320 coupling the aerodynamic wing 310 to the steering unit 330. The short coupling line 354 is hauled in as shown in FIG. 5, so that the force induced by the weight of the guiding line 350 does not act directly onto the aerodynamic wing 310 but onto the steering unit 330. During starting and landing manoeuvres the coupling line 354 may be veered out (not shown) to allow a direct pulling force to be exerted to the aerodynamic wing 310 via the guiding line 350.

Figure 6:
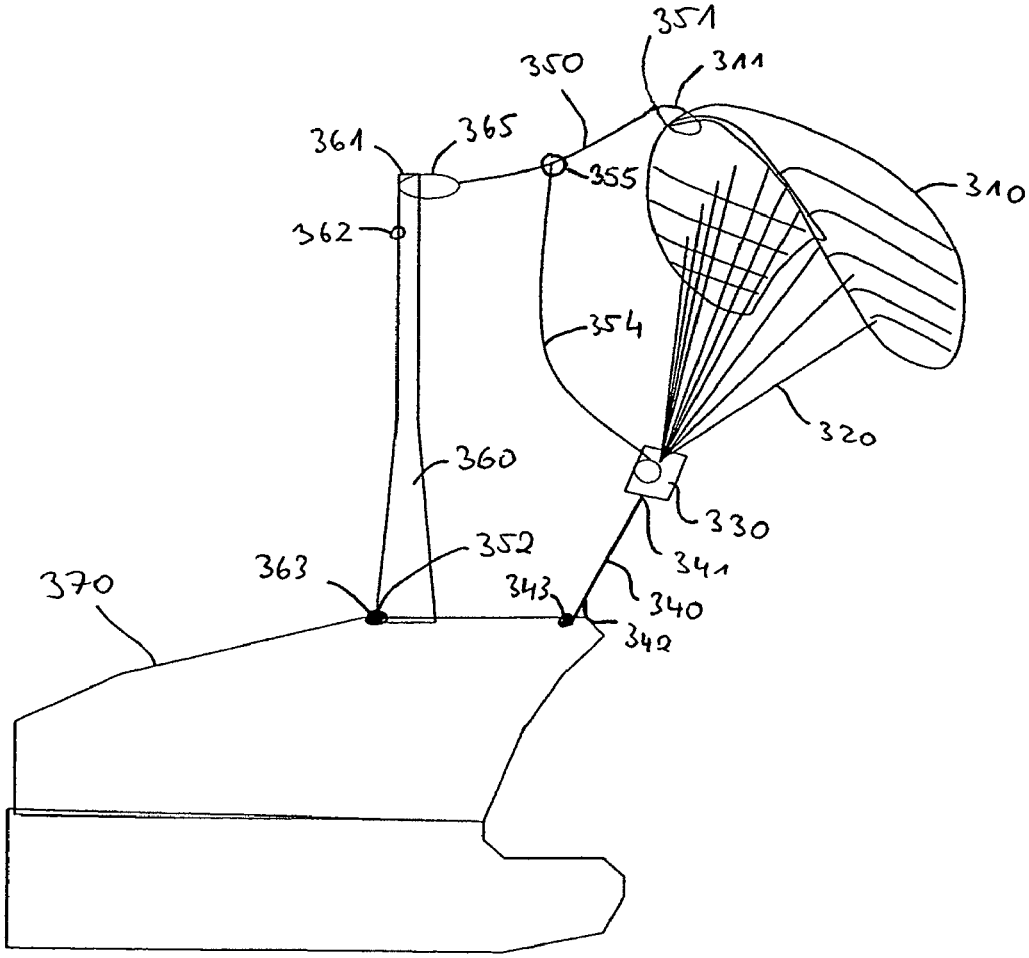

FIG. 6 shows a perspective view of the third embodiment of the device according to the invention in the starting and landing condition. As shown, the guiding line 350 is now directly acting via its first end 351 onto the aerodynamic wing whereas the coupling line 354 is veered out to avoid load transmission from the guiding line to the steering unit 330. The first end 351 of the guiding line thus is fixed to the central stick 311. The second end 352 of the guiding line is fixed to the base platform 370 via a winch 363. The coupling line 354 is connected to the guiding line 350 via a slidable element 355 which can slide along the guiding line. The sliding movement between the guiding line and the slidable element 355 can be blocked when the coupling line 350 is completely hauled in and thus the guiding line 340 is connected to the steering unit 330. This will prevent a direct pulling force to be exerted to the aerodynamic wing 310 via the guiding line 350.

Alternatively, the coupling line 354 can be connected to the guiding line 350 at a defined fixing point. In this case the length of the section of the guiding line between the fixing point of the coupling line 354 and the central stick 311 must have at least the length of the distance between the central stick 311 and the steering unit 330.

Figure 7:
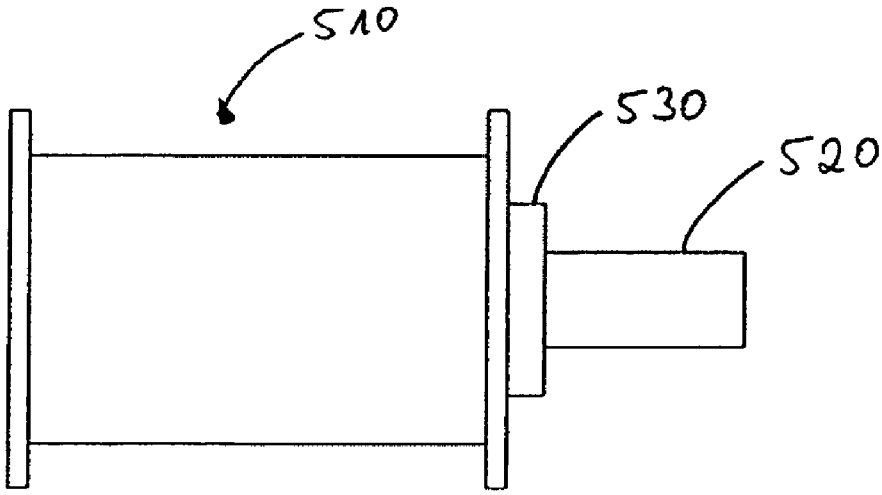

FIG. 7 shows a schematic view of a detail of a fourth embodiment of the device according to the invention. A winch 510 is connected to a first drive unit 520 and to a second drive unit (not shown) via a coupling 530 for selectively coupling one of the two drive units to the winch 510. In FIG. 7 the first drive unit 520 is coupled via the coupling 530 to the winch 510. The first drive unit 520 is capable of being operated in a first mode that applies a low torque with high speed to the winch 510 when the winch 510 is coupled via the coupling 530 to the first drive unit and the winch 510 thus applies a low force with high speed to a line (not shown) associated with the winch. The second drive unit (not shown) is capable of being operated in a second mode that applies a high torque with low speed to the winch 510 when the winch 510 is coupled via the coupling 530 to the second drive unit and the winch 510 thus applies a low force with high speed to a line (not shown) associated with the winch.

The invention claimed is:

1. An aerodynamic wind propulsion device, comprising an aerodynamic wing being connected to a steering unit located below the aerodynamic wing via a plurality of lines, a tractive cable, having a first end of the tractive cable connected to the steering unit and a second end of the tractive cable connected to a base platform, the aerodynamic wing having an aerodynamic profile which generates an uplift force in the direction of the traction cable when an airflow direction is about perpendicular to the tractive cable, a guiding line having a first end connected to the aerodynamic wing or to the steering unit, a pole being connected to the base platform, the pole serving as a docking point for the aerodynamic wing during starting and landing, characterized in that a second end of the guiding line is connected to the base platform during and between starting and landing maneuvers wherein the guiding line is guided through or along the pole and is capable of transferring a tensile force onto the aerodynamic wing at least during starting or landing.

2. An aerodynamic wind propulsion device according to claim 1, wherein the first end of the guiding line is connected to a rigid stiffening element secured to the aerodynamic wing.

3. An aerodynamic wind propulsion device according to claim 2, wherein the stiffening element comprises a central stick.

4. An aerodynamic wind propulsion device according to claim 2, wherein the pole comprises an adapter element at a top of the pole, configured to be mechanically coupled to the stiffening element.

5. An aerodynamic wind propulsion device according to claim 1, characterized in that a plurality of reefing lines is located across the aerodynamic wing in order to change the aerodynamic profile or dimension of the aerodynamic wing in a manner that aerodynamic properties are changed when the reefing lines are hauled in.

6. An aerodynamic wind propulsion device according to claim 5, characterized in that the first end of the guiding line is connected to the plurality of reefing lines to effect hauling-in via the guiding line.

7. An aerodynamic wind propulsion device according to claim 6, characterized in that the plurality of reefing lines is at least partially guided along a stiffening element secured to the aerodynamic wing.

8. An aerodynamic wind propulsion device according to claim 7, characterized in a blocking element preventing hauling-in of the reefing lines in a blocking state and allowing hauling-in of the reefing lines in a non-blocking state via a load transmission connection between the plurality of reefing lines and the first end of the guiding line.

9. An aerodynamic wind propulsion device according to claim 7, wherein the stiffening element comprises a central stick.

10. An aerodynamic wind propulsion device according to claim 5, wherein the aerodynamic properties being changed comprises the uplift force being reduced when the reefing lines are hauled in.

11. An aerodynamic wind propulsion device according to claim 1, wherein the plurality of lines comprises steering lines and/or tractive lines.

12. An aerodynamic wind propulsion device according to claim 1, wherein the pole comprises a mast.

13. An aerodynamic wind propulsion device according to claim 12, wherein the mast element comprises a telescope mast and/or a mast having a pivotal coupling to the base platform to fold the mast and bring it into an essentially horizontal orientation.

14. An aerodynamic wind propulsion device according to claim 12, wherein the guiding line is inserted into a head of the mast, and is guided via a pulley.

15. An aerodynamic wind propulsion device according to claim 1, characterized in that the guiding line is inserted into the pole at the top, and is guided via a pulley.

16. An aerodynamic wind propulsion device according to claim 1, wherein the tractive cable is capable of carrying high tensile forces and/or the guiding line is capable of carrying low tensile forces.

17. An aerodynamic wind propulsion device according to claim 16, wherein the guiding line is capable of carrying tensile forces of about 0.5-3% of the tensile forces of the tractive cable.

18. An aerodynamic wind propulsion device according to claim 16, wherein the guiding line is capable of carrying tenside forces of about 1% of the tensile forces of the tractive cable.

19. An aerodynamic wind propulsion device according to claim 1, wherein a signal transmission line and/or a power transmission line is included in the guiding line.

20. An aerodynamic wind propulsion device according to claim 1, characterized by a coupling element for selectively fixing the guiding line to the steering unit.

21. An aerodynamic wind propulsion device according to claim 1, wherein a section of the guiding line extends between the base platform and the top of the pole and wherein the pole comprises a tractive device, that is capable of applying a tensile force to this section.

22. An aerodynamic wind propulsion device according to claim 21, wherein the tractive device is a pair of tension pulleys arranged opposed to each other and engaging the guiding line between them, wherein at least one of the tension pulleys is capable of applying the tensile force via a torque onto the guiding line.

23. An aerodynamic wind propulsion device according to claim 22, wherein at least one of the tension pulleys is being driven by a driving assembly.

24. An aerodynamic wind propulsion device according to claim 23, wherein the tension pulleys can be set to a mode wherein they are free to rotate to follow a movement of the guiding line or the tractive cable respectively.

25. An aerodynamic wind propulsion device according to claim 23, wherein the driving assembly is a rotating field magnet.

26. An aerodynamic wind propulsion device according to claim 22, wherein the torque and/or the tensile force of the tension pulleys can be adjusted.

27. An aerodynamic wind propulsion device according to claim 26, wherein the torque and/or the tensile force of the tension pulleys can be adjusted to compensate for wear on the tension pulleys or the guiding line or the tractive cable respectively.

28. An aerodynamic wind propulsion device according to claim 1, wherein the second end of the tractive cable and/or the second end of the guiding line are connected to the base platform via at least one winch for veering-out and hauling-in the tractive cable or the guiding line respectively, characterized in that the at least one winch is equipped with two operating modes, wherein the first operating mode applies a low force with high speed and the second operating mode applies a high force with low speed.

29. An aerodynamic wind propulsion device according to claim 28, characterized in that the at least one winch is connected to one drive unit and the said drive unit is capable of being operated in the two modes or two separate drive units are provided, one drive unit being capable of being operated in the first mode and the other drive unit being capable of being operated in the second mode.

30. An aerodynamic wind propulsion device according to claim 29, having two separate drive units, further comprising at least one coupling for selectively coupling one of the two drive units to the at least one winch.

31. A watercraft comprising an aerodynamic wind propulsion device according to claim 1.

32. The use of an aerodynamic wind propulsion device according to claim 1 to drive a watercraft.

33. The use of an aerodynamic wind propulsion device according to claim 1 to start, land, fly and/or rescue an aerodynamic wing.

34. A method for controlling an aerodynamic wind propulsion device, comprising the steps of connecting an aerodynamic wing to a steering unit located below the aerodynamic wing via a plurality of lines, connecting a first end of a tractive cable to the steering unit and a second end of the tractive cable to a base platform, connecting a first end of a guiding line to the aerodynamic wing or to the steering unit, providing a pole being connected to the base platform, serving as a docking point for the aerodynamic wing during starting and landing, steering the flight of the aerodynamic wing via the steering unit, characterized by the steps connecting a second end of the guiding line to the base platform, guiding the guiding line through or along the pole during and between starting and landing maneuvers, managing the tensile force in the guiding line according to different functions of the guiding line at least during starting and landing maneuvers.

35. A method according to claim 34, characterized by the step of adjusting the tensile force applied to the guiding line at its second end, in response to the tensile force applied to the guiding line at its first end, through the uplift force of the aerodynamic wing so that a certain tensile force is sustained in the guiding line during a guiding phase as part of starting or landing maneuvers.

36. A method according to claim 34, characterized by the step of veering-out and hauling-in the guiding line parallel to the traction cable during a flying phase, wherein little or no tensile force is sustained in the guiding line.

37. A method according to claim 34, characterized by the step of hauling-in of the guiding line via applying a force at the second end of the guiding line during landing or in order to rescue the aerodynamic wing in a situation of instability.

38. A method according to claim 34, characterized in that during a starting phase the aerodynamic wing is unfolded using a driving assembly with high power and low speed.

39. A method according to claim 34, characterized by the steps of providing at least one winch connected to the second end of the tractive cable and/or the second end of the guiding line for veering-out and hauling-in the tractive cable or the guiding line respectively, operating the at least one winch in two operating modes, wherein the first operating mode applies a low force with high speed and the second operating mode applies a high force with low speed.

40. A method according to claim 39, wherein the winch of the guiding line is operated in the first operating mode during the guiding phase, the winch of the guiding line is operated in the second operating mode during unfolding and folding of the aerodynamic wing and the winch of the guiding line is operated in first operating mode or the second mode during the rescue maneuvers.

41. A method according to claim 34, characterized by the step of applying a tensile force to a section of the guiding line between the base platform and the top of the pole wherein the pole comprises a tractive device that is capable of applying a tensile force onto the guiding line.

42. A method according to claim 41, characterized by the step of driving the tractive device by a driving assembly.

43. A method according to claim 42, wherein the driving assembly comprises a rotating field magnet.

44. A method according to claim 41, characterized by the step of adjusting the torque and/or the tensile force of the tractive device.

45. A method according to claim 44, wherein adjusting the torque and/or the tensile force of the tractive device comprises compensating for wear of the guiding line or the tension pulleys.

46. A method according to claim 41, wherein the tractive device comprises a pair of tension pulleys arranged opposed to each other and engaging the guiding line between them.

47. A method according to claim 41, wherein the tractive device is capable of applying the tensile force via a torque.

48. A method according to claim 34, characterized in that signals and/or power are transmitted via a signal line and/or a power line included in the guiding line.

49. A method according to claim 34, characterized in that the guiding line is fixed to the steering unit at least between starting and landing of the wing.

50. A method for controlling an aerodynamic wind propulsion device according to claim 34, further comprising controlling a watercraft.

51. A method according to claim 34, wherein the plurality of lines comprise steering lines and/or tractive lines.

52. A method according to claim 34, wherein the pole comprises a mast.

* * * * *